US008991069B2

(12) United States Patent
Jones

(10) Patent No.: US 8,991,069 B2
(45) Date of Patent: Mar. 31, 2015

(54) TRACTION DEVICE FOR FOOTWEAR

(75) Inventor: Merrick Jones, Raleigh, NC (US)

(73) Assignee: Implus Footcare, LLC, Durham, NC (US)

( * ) Notice: Subject to any disclaimer, the term of this patent is extended or adjusted under 35 U.S.C. 154(b) by 165 days.

(21) Appl. No.: 13/475,747

(22) Filed: May 18, 2012

(65) Prior Publication Data

US 2013/0305565 A1 Nov. 21, 2013

(51) Int. Cl.

| | |
|---|---|
| ***A43B 3/16*** | (2006.01) |
| ***A43C 15/00*** | (2006.01) |
| ***A43C 15/10*** | (2006.01) |
| ***A43B 5/18*** | (2006.01) |
| ***A43C 15/06*** | (2006.01) |

(52) U.S. Cl.

CPC . *A43B 5/18* (2013.01); *A43C 15/10* (2013.01); *A43C 15/063* (2013.01); *A43C 15/066* (2013.01); *A43C 15/061* (2013.01)

USPC ..... 36/7.6; 36/62

(58) Field of Classification Search

CPC ..... A43B 3/16; A43B 5/18; A43C 15/00; A43C 15/061; A43C 15/063; A43C 15/066; A43C 15/10

USPC ..... 36/7.6, 7.7, 59 R, 59 D, 62

See application file for complete search history.

(56) References Cited

U.S. PATENT DOCUMENTS

| | | | | |
|---|---|---|---|---|
| 4,434,565 | A * | 3/1984 | Haley | 36/7.3 |
| 5,315,768 | A * | 5/1994 | Pacheco | 36/7.1 R |
| 5,813,143 | A * | 9/1998 | Bell et al. | 36/59 R |
| 5,836,090 | A * | 11/1998 | Smith | 36/7.6 |
| 5,909,945 | A * | 6/1999 | Noy | 36/7.6 |
| 5,921,005 | A * | 7/1999 | Bell et al. | 36/59 R |
| 5,960,568 | A * | 10/1999 | Bell et al. | 36/134 |
| 6,154,982 | A * | 12/2000 | Bell et al. | 36/7.6 |
| 7,409,782 | B2 * | 8/2008 | Larson et al. | 36/59 R |
| 7,461,467 | B2 * | 12/2008 | Park et al. | 36/7.6 |
| 2010/0058615 | A1 | 3/2010 | Couder | |
| 2010/0139118 | A1 * | 6/2010 | Park | 36/7.6 |
| 2011/0099847 | A1 | 5/2011 | Koe-Krompecher | |

FOREIGN PATENT DOCUMENTS

WO 2005/079478 A2 9/2005

OTHER PUBLICATIONS

The Extended European Search Report issued Jul. 22, 2013, by the European Patent Office in corresponding European Patent Application No. 13165567.2-1655. (6 pages).

* cited by examiner

*Primary Examiner* — Khoa Huynh
*Assistant Examiner* — Sharon M Prange
(74) *Attorney, Agent, or Firm* — Buchanan, Ingersoll & Rooney PC

(57) ABSTRACT

A removable traction device for wearing over an article of footwear includes an outer peripheral band; a traction area defined within the outer peripheral band and including a removable traction member; and a plurality of resilient connecting strands extending between the traction area and the outer peripheral band. The traction area includes an exterior ground engaging surface and an interior surface opposite thereto and the interior surface includes a peripheral flange defining a traction member receiving pocket, such that the removable traction member is insertable into and removable from the traction member receiving pocket.

11 Claims, 8 Drawing Sheets

TRACTION DEVICE FOR FOOTWEAR

FIELD OF THE INVENTION

The present invention is directed to a traction device for footwear, and more particularly, to a removable traction device intended to be worn over a conventional shoe or boot to improve traction for the wearer when traversing potentially slick or slippery surfaces, such as caused by sleet, snow, ice and the like.

BACKGROUND OF THE INVENTION

Many type of conventional footwear, including dress shoes, work boots and even athletic shoes, may not provide adequate traction for the wearer on certain types of slippery or wet surfaces. Hence, in attempting to traverse such a slippery, icy or wet surface, injury may occur.

In order to avoid the likelihood of injury, a number of solutions have been proposed, such as non-slip footwear and footwear attachment devices, which are aimed at increasing the traction between the wearer and the slippery surface. One example of such a device is disclosed in U.S. Pat. No. 5,909,945 to the present assignee, the entire contents of which are hereby incorporated by reference. While this device has been commercially successful over the years, it is not readily adaptable to different surface conditions that might be encountered by a wearer or wearer preferences. Another example is disclosed in U.S. Patent Publication No. U.S. 2010/0058615 to the present assignee, the entire contents of which are also hereby incorporated by reference, but this device is more suitable for indoor use and conditions.

Accordingly, it would thus be desirable to provide user friendly non-slip footwear that is economical, adaptable to a variety of footwear and wearer preferences, and which is also adaptable to a variety of surface conditions.

SUMMARY OF THE INVENTION

These and other objects are achieved by the removable traction device of the present invention. According to one aspect of the invention, a removable traction device for wearing over an article of footwear comprises an outer peripheral band; a traction area defined within said outer peripheral band and including a removable traction member; and a plurality of resilient connecting strands extending between said traction area and said outer peripheral band; wherein said traction area includes an exterior ground engaging surface and an interior surface opposite thereto; and wherein the interior surface includes a peripheral flange defining a traction member receiving pocket, said removable traction member being insertable into and removable from said traction member receiving pocket.

In accordance with a further aspect of the invention, wire traction enhancing members are provided to encircle at least some of said plurality of resilient connecting strands. The wire traction enhancing members comprise a wire formed into a coil around at least some of said plurality of resilient connecting strands. Still further, the wire has a non-circular cross-section and/or the coil has a non-circular configuration.

BRIEF DESCRIPTION OF THE DRAWING FIGURES

These and other objects, features, and advantages of the present invention will become more readily apparent to those skilled in the art upon reading the following detailed description, in conjunction with the appended drawings in which.

Figure 1:
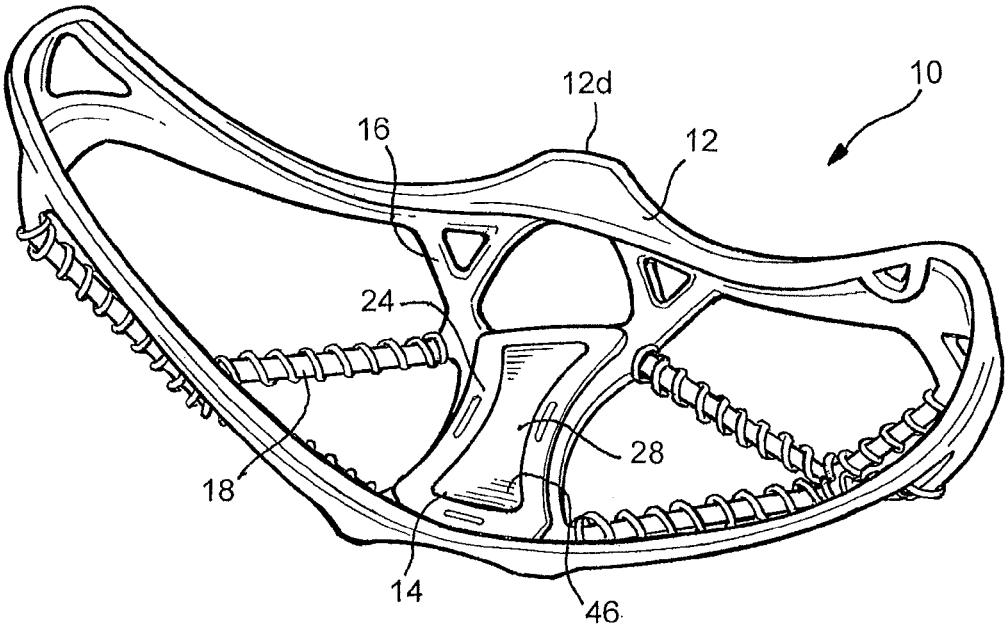
FIG. 1 is a top perspective view of a traction device for footwear according to an embodiment of the invention.
Figure 6A:
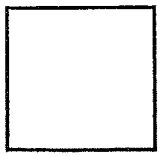
Figure 6B:
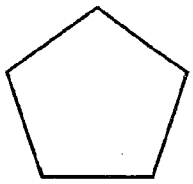
Figure 6C:
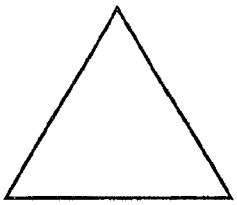
Figure 7A:
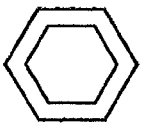
Figure 7B:
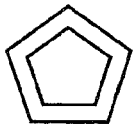
Figure 7C:
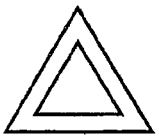
Figure 7D:
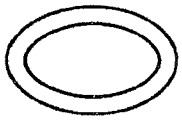

FIGS. 6A-6C disclose various cross-sectional shapes of a wire used to form the coil spring shown in FIG. 1.

FIGS. 7A-7D disclose various profile configurations for the coil spring shown in FIG. 1.

Figure 8:
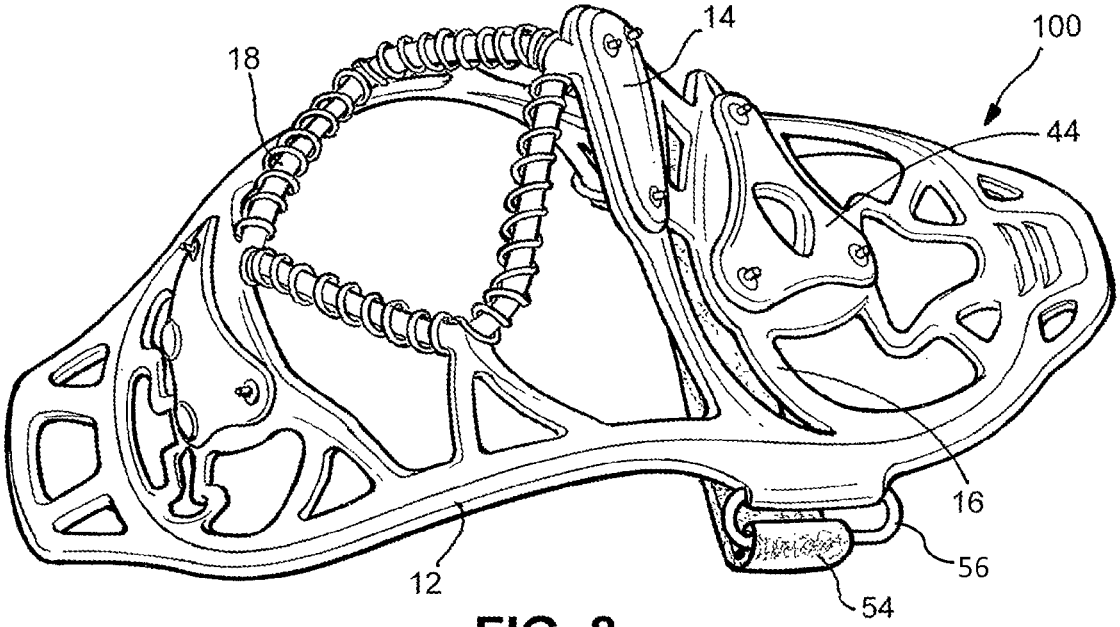

FIG. 8 is a bottom perspective view of a traction device for footwear according to a further embodiment of the invention.

Figure 9:
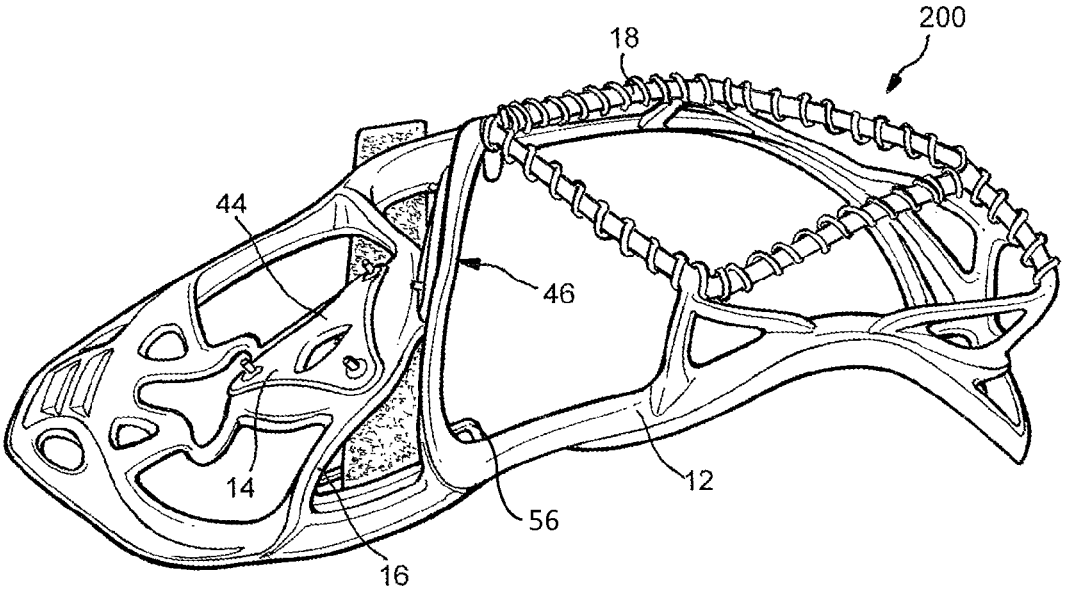

FIG. 9 is a bottom perspective view of a traction device for footwear according to yet another embodiment of the invention.

Figure 10:
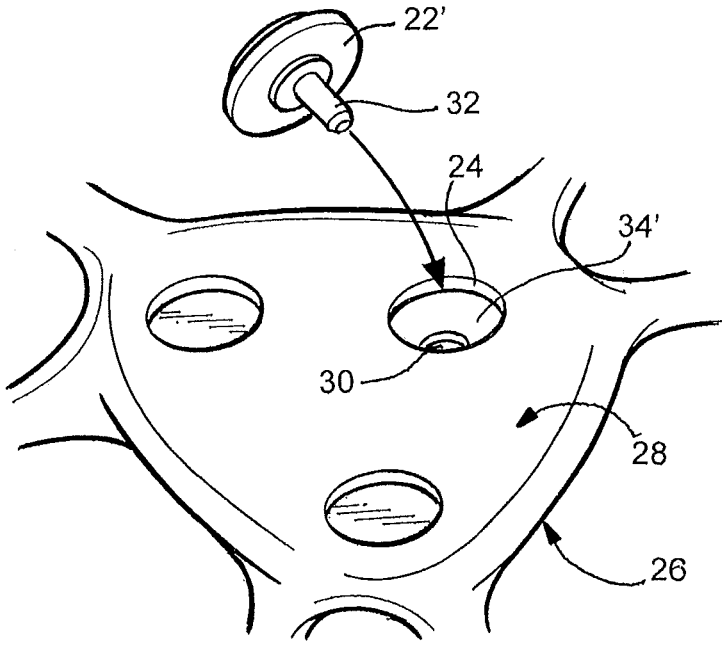

FIG. 10 is a schematic view showing the removable traction member of FIGS. 8 and 9.

Figure 11:
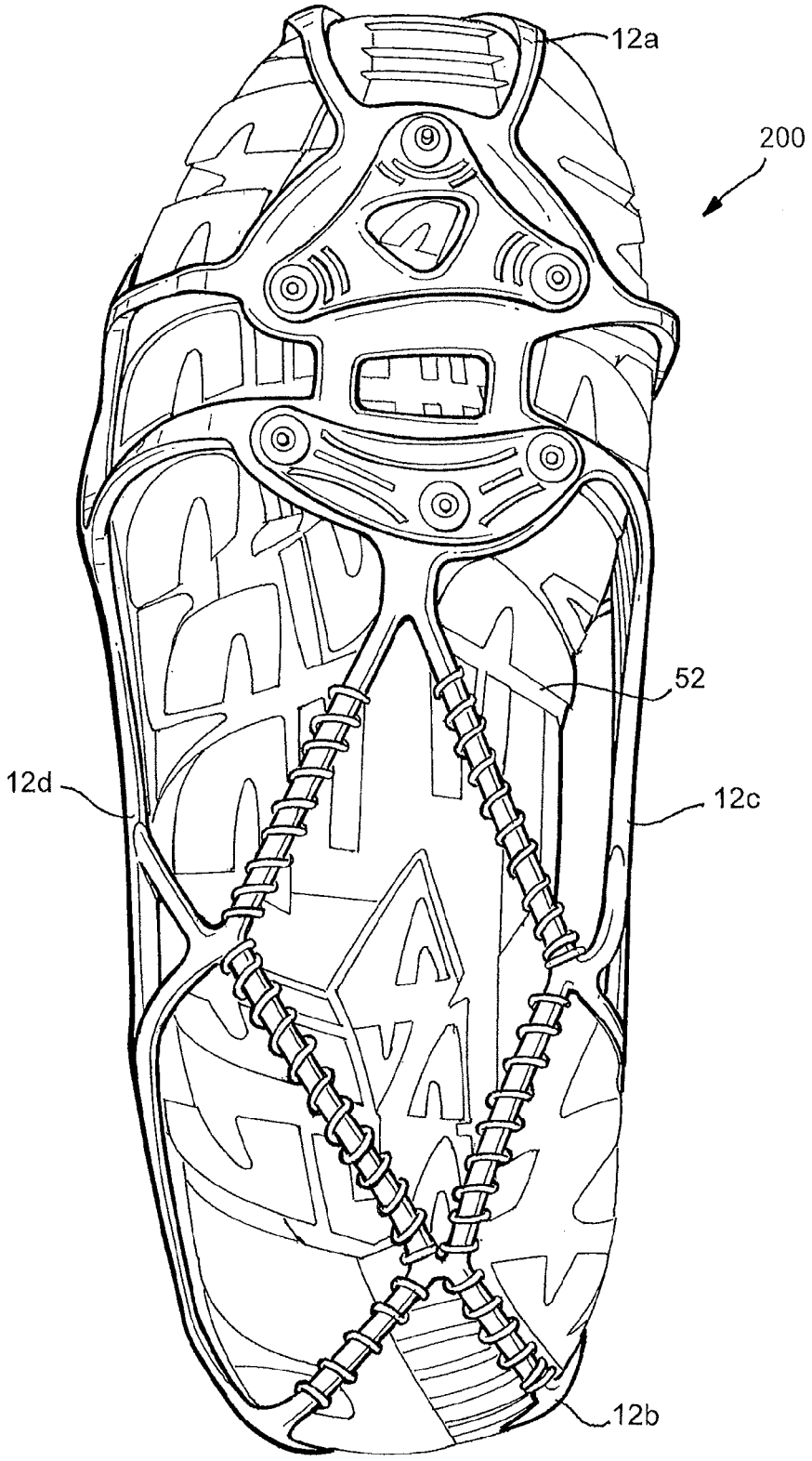

FIG. 11 is a bottom view of the traction device shown in FIG. 9 when worn over a conventional article of footwear.

Figure 12:
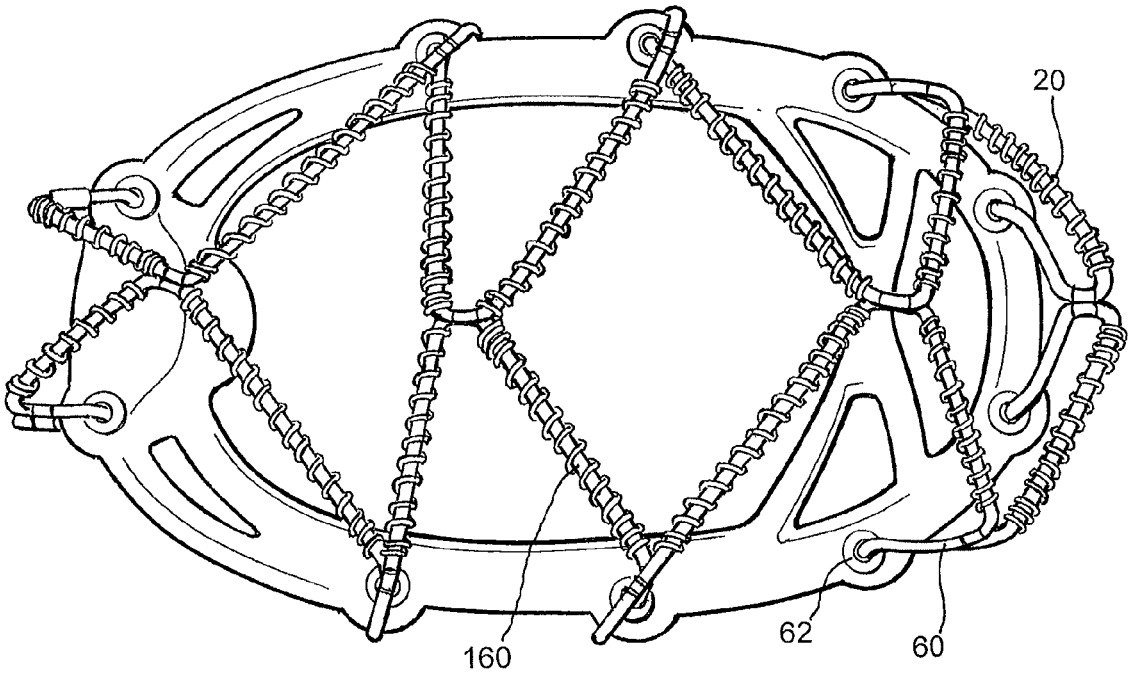

FIG. 12 is a bottom perspective view of a traction device for footwear according to yet another embodiment of the invention.

DETAILED DESCRIPTION

Referring to FIGS. 1-5, a traction device for footwear in accordance with a preferred embodiment of the invention is shown generally by reference numeral 10. Traction device 10 includes an outer peripheral band 12, a traction area 14, and a plurality of resilient connecting members 16, 18, all of which are preferably molded as an integral or one-piece member. The traction device is preferably formed (e.g., molded) from a flexible and resilient elastomeric material, e.g., rubber, PVC, 5-10 rubber, etc., that is slip and oil resistant. As described in detail below, the outer peripheral band 12 can adapt to the shape of different footwear such that the traction device 10 can be easily stretched by a wearer into a non-planar shape for removably mounting the traction device over an article of footwear.

The traction device 10 includes a lower surface 44 intended to face towards the slick, icy or slippery ground surface when worn and an upper surface 46 intended to face towards the article of footwear over which the traction 10 is worn. The traction area 14 also includes an exterior ground engaging surface 26 and an interior surface 28 opposite thereto. The interior surface 28 of the traction area 14 includes a peripheral flange 24 defining a traction plate receiving pocket 34 for securing a traction plate 22 therewithin. The traction plate 22 defines a first ground engaging surface 36 including a plurality of traction elements and a second surface 38 opposite thereto and facing towards the article of footwear, when worn. The exterior surface 26 of the traction area 14 further includes a plurality of openings 30 and a first surface 36 of the traction plate 22 including a plurality of traction elements 32 extending through the plurality of openings 30. Thus, traction plate 22 can removably secured within the traction area 14 when the periphery of the traction plate 22 is received within the traction plate receiving pocket 34 and the traction elements 32 are extended through the openings 30.

In a preferred embodiment of the invention, the traction plate 22 is formed from a plastic material, such as nylon, for example and the traction element 32 is a metal spike element made from tungsten steel.

The outer peripheral band 12 has an approximately oval shape with a generally rounded front or toe section 12*a*, a generally rounded rear or heel section 12*b*, and two side sections 12*c* and 12*d* interconnecting the toe and heel sections 12*a* and 12*b*. The toe section 12*a* is preferably rounded so as to prevent the toe from catching and causing the wearer to trip and/or fall. The heel section 12*b* preferably includes a slight extension defining a heel tab 48 to assist the user in donning the traction device 10 over a conventional article of footwear, as described further below. The side sections 12*c*, 12*d* also include protruding tabs 50*a*, 50*b* for the purpose of better fitting a multitude of footwear types.

The plurality of connecting strands 16, 18 include first connecting members 16 preferably connecting the traction area 14 to the side sections 12*c*, 12*d* of the peripheral band 12, and second connecting members 18 preferably connecting the traction area 14 to front section 12*a* and/or rear section 12*b* the peripheral band 12.

Figure 5:
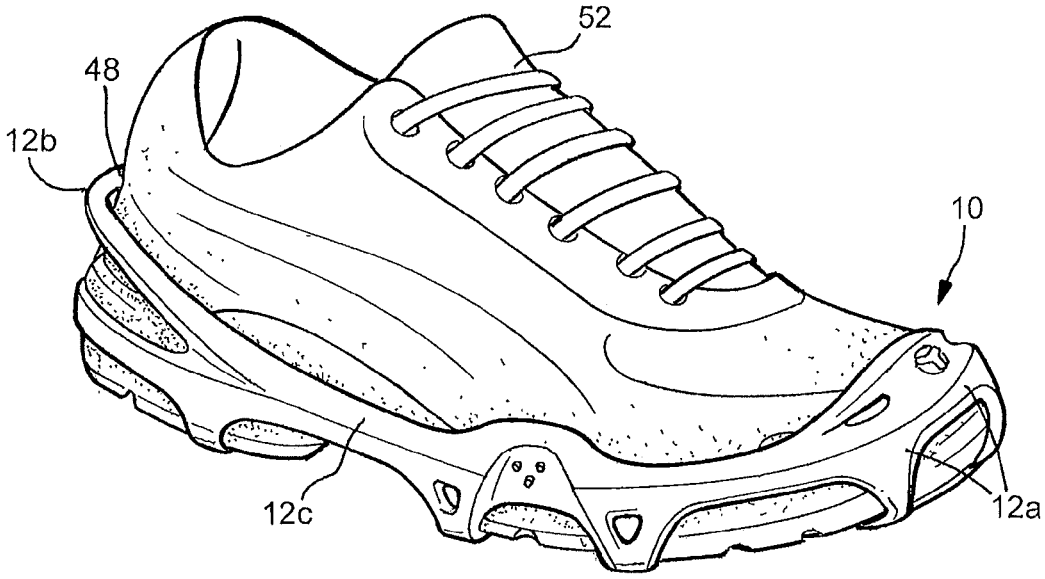
FIG. 5 is a side elevational view of the traction device shown in FIG. 1 when worn over a conventional article of footwear.

Referring to FIG. 5, traction device 10 is illustrated as it is intended to be worn over an article of footwear 52. As generally shown, the outer peripheral band 12 is stretched so as to surround the toe, side portions, and heel of the article of footwear 52. That is, the rounded front or toe section 12*a* is stretched over the toe portion of the footwear 52, the generally rounded rear section 12*b* is stretched over the heel portion of the footwear 52, with the assistance of heel tab 48, and the two side sections 12*c*, 12*d* extend along the sides of the upper of the footwear 52, thereby encircling the same.

Figure 2:
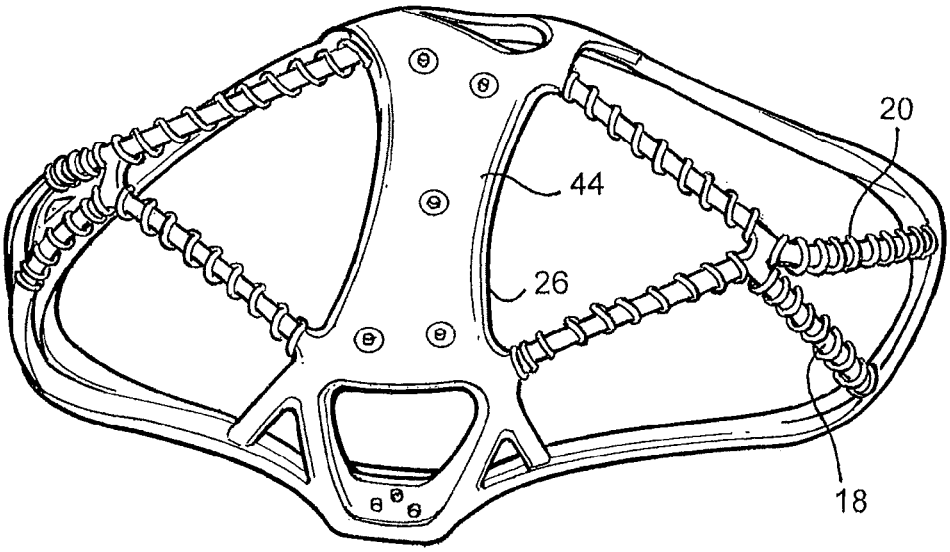
FIG. 2 is a bottom perspective view of the traction device shown in FIG. 1.
Figure 3:
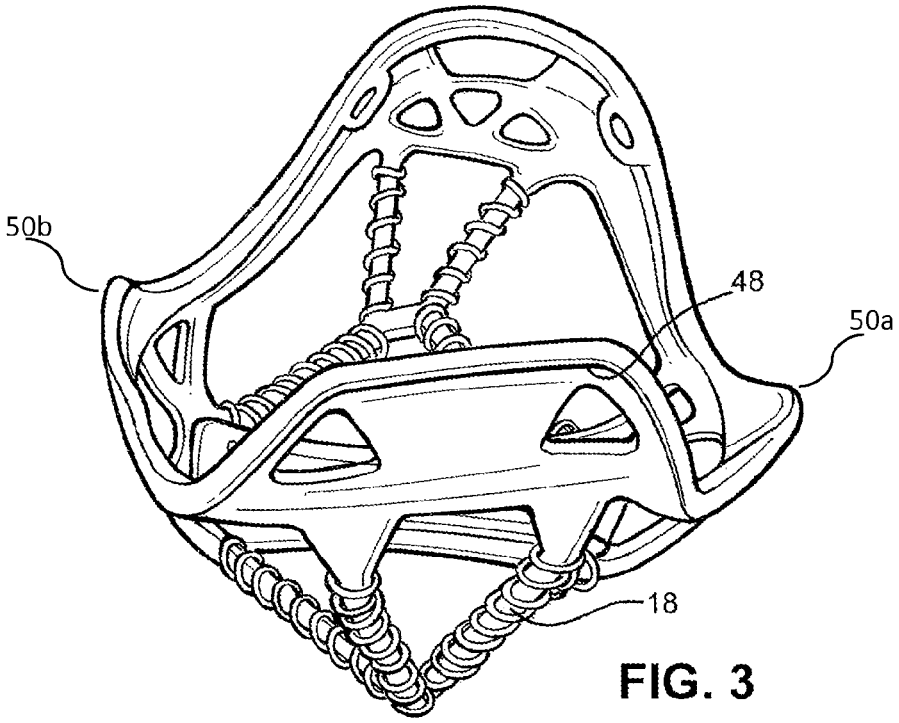
FIG. 3 is a rear perspective view of the traction device shown in FIG. 1.
Figure 4:
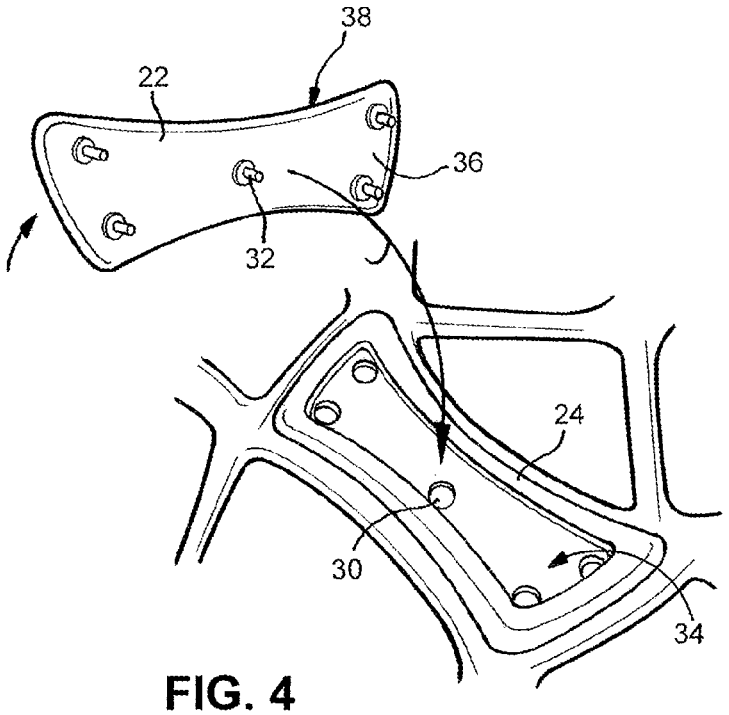
FIG. 4 is a schematic view showing the removable traction member of FIG. 1.

In accordance with a further aspect of the invention, and as shown best in FIG. 2, wire traction enhancing members 20 may be provided to encircle at least some of the second connecting members 18 in order to increase the traction that they provide. The wire traction enhancing members 20 may be formed as circular, or even non-circular, coil springs. Moreover, the wire utilized to form wire traction enhancing members 20 may have a convention circular cross-section or any other non-circular cross-section. For example, referring to FIGS. 6A-6C, a rectangular, pentagonal or triangular wire may be used to form a circular coil or spring which defines the wire traction enhancing members 20. Still further, referring to FIGS. 7A-7D, respectively, a coil or spring having a non-circular configuration, such as, for example, a hexagonal, pentagonal, triangular or oval profile may also be used to encircle the second connecting members 18, each of which could be formed from a wire having a non-circular cross-section. Other configurations or combinations for the wire and/or coil profile forming the wire traction enhancing members 20 are of course also possible, as one skilled in the art would readily appreciate, as well as the fact that said configurations and combinations may be utilized on a conventional traction device, such as shown in U.S. Pat. No. 5,909,945, without the removable traction plate 22 described above relative to FIGS. 1-5.

Referring to FIG. 8, a traction device for footwear in accordance with a further embodiment of the invention is shown generally by reference numeral 100, and yet a still further embodiment is shown in FIG. 9 and designated by reference numeral 200, wherein like reference numerals are used to describe like elements shown in the embodiment of FIGS. 1-5. Traction device 100, 200 includes an outer peripheral band 12, at least one traction area 14, and a plurality of resilient connecting members 16, 18, all of which are preferably molded as an integral or one-piece member. The traction device is preferably formed (e.g., molded) from a flexible and resilient elastomeric material, e.g., rubber, PVC, 5-10 rubber, etc., that is slip and oil resistant. As described in detail below, the outer peripheral band 12 can adapt to the shape of different footwear such that the traction device 100, 200 can be easily stretched by a wearer into a non-planar shape for removably mounting the traction device over an article of footwear.

The traction device 100, 200 includes a lower surface 44 intended to face towards the slick, icy or slippery ground surface when worn and an upper surface 46 intended to face towards the article of footwear over which the traction 10 is worn. As best shown in FIG. 10, the at least one traction area 14 also includes an exterior ground engaging surface 26 and an upper or interior surface 28 opposite thereto that is intended to face towards the article of footwear when worn. The interior surface 28 of the at least one traction area 14 includes at least one traction member receiving pocket 34' defined by a peripheral flange 24 for securing a traction member 22' therewithin. The traction member 22' includes a traction element 32. The exterior surface 26 of the at least one traction area 14 further includes at least one opening 30 such that each traction element 32 can extend through an opening 30. Thus, each traction member 22' is individually and removably secured within at least one traction area 14 when the periphery of the traction member 22' is received within the traction member receiving pocket 34' and the traction element 32 extends through the corresponding opening 30.

The outer peripheral band 12 has an approximately oval shape with a generally rounded front or toe section 12*a*, a generally rounded rear or heel section 12*b*, and two side sections 12*c* and 12*d* interconnecting the toe and heel sections 12*a* and 12*b*. The toe section 12*a* is preferably rounded so as to prevent the toe from catching and causing the wearer to trip and/or fall. The heel section 12*b* preferably includes a slight extension defining a heel tab 48 to assist the user in donning the traction device 10 over a conventional article of footwear, as described further below. The side sections 12*c*, 12*d* also include protruding tabs 50*a*, 50*b*. In addition, to further secure traction device 100, 200 on the article of footwear 52, a strap 54, such as a VELCRO® strap, is provided between two opposing rings 56 or other connecting loops, brackets, or the like.

The plurality of connecting strands 16, 18 include first connecting members 16 preferably connecting at least one traction area 14 to the peripheral band 12, and second connecting members 18 preferably connecting at least one traction area 14 to the peripheral band 12. As described above relative to the embodiment of FIGS. 1-5, and with reference also to FIGS. 6A-6C, 7A-7D, wire traction enhancing members 20 may be provided to encircle at least some of the second connecting members 18 in order to increase the traction that they provide.

Referring to FIG. 11, traction device 200 is illustrated as it is intended to be worn over an article of footwear 52. As generally shown, the outer peripheral band 12 is stretched so as to surround the toe, side portions, and heel of the article of footwear 52. That is, the rounded front or toe section 12*a* is stretched over the toe portion of the footwear 52, the generally rounded rear section 12*b* is stretched over the heel portion of the footwear 52, with the assistance of heel tab 48, and the two side sections 12*c*, 12*d* extend along the sides of the upper of the footwear 52, thereby encircling the same.

A further embodiment of the invention is illustrated in FIG. 12, in which traction device 300 has connecting members 160 formed from a climbing cord or rope instead of the resilient elastomeric material discussed above for first and second connecting members 16 and 18. The connecting members 160 are preferably formed from a double braided polyester/nylon rope 60 designed for general climbing use where low elongation, high strength, and abrasion resistance are required. Such ropes are commercially available from Mammut Sports Group Inc., Sterling Rope or PMI (PMI Maxwear). A preferred diameter of rope for use in the present invention is approximately 3.0 to 3.2 mm. The rope 60 is inserted through openings, metal grommets 62, or the like, which are disposed around the periphery of the traction device 300. In addition, wire traction enhancing members 20 can encircle all or portions of the rope 60.

While the present invention has been described with respect to a particular embodiment of the present invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the present invention.

What is claimed is:

1. A removable traction device for wearing over an article of footwear, said traction device comprising:

an outer peripheral band;

a traction area defined within said outer peripheral band, said traction area including an exterior ground engaging surface and a footwear engaging surface opposite thereto;

a removable traction member having an outer perimeter, said traction member comprising a traction plate having a first surface and a second surface opposite thereto, at least one traction element projecting from said first surface of said traction plate;

a plurality of resilient connecting strands extending between said traction area and said outer peripheral band; and a traction member receiving pocket configured to receive the outer perimeter of said removable traction member within said pocket, said removable traction member thus being insertable into and removable from said traction member receiving pocket of said traction device;

wherein said traction member receiving pocket comprises a flange extending from the footwear engaging surface and overlapping a portion of the traction area, said flange overlapping a portion of the second surface of said traction member when said traction member is disposed within the traction member receiving pocket.

2. The traction device according to claim 1, wherein said exterior ground engaging surface of said traction area includes a plurality of openings.

3. The traction device according to claim 2, wherein said at least one traction element projecting from said first surface of said traction plate includes a plurality of traction elements, said plurality of traction elements extending through said plurality of openings in said exterior ground engaging surface of said traction area when said traction plate is disposed within said traction member receiving pocket.

4. The traction device according to claim 3, wherein said traction elements comprise metal projections.

5. The traction device according to claim 1, wherein said traction plate is formed from a plastic material.

6. The traction device according to claim 1, wherein said traction device is formed from an elastomeric material.

7. The traction device according to claim 6, wherein said outer peripheral band is stretchable so as to surround a toe portion, heel portion and opposing side portions of the article of footwear.

8. The traction device according to claim 1, further comprising wire traction enhancing members encircling at least some of said plurality of resilient connecting strands.

9. The traction device according to claim 8, wherein said wire traction enhancing members comprise a wire formed into a coil around at least some of said plurality of resilient connecting strands.

10. The traction device according to claim 9, wherein said wire has a non-circular cross-section.

11. The traction device according to claim 9, wherein said coil has a non-circular configuration.

* * * * *